US006003751A

United States Patent [19]

Ohmae

[11] Patent Number: 6,003,751

[45] Date of Patent: Dec. 21, 1999

[54] TAR REMOVING MECHANISM FOR PNEUMATIC NAILING MACHINE

[75] Inventor: Hiroaki Ohmae, Tokyo, Japan

[73] Assignee: Max Co., Ltd., Tokyo, Japan

[21] Appl. No.: 09/074,596

[22] Filed: May 8, 1998

[30] Foreign Application Priority Data

May 9, 1997 [JP] Japan ..... 9-135852

[51] Int. Cl.[6] ..... B25C 1/04

[52] U.S. Cl. ..... 227/130; 227/119; 227/156

[58] Field of Search ..... 227/130, 8, 156, 227/119

[56] References Cited

U.S. PATENT DOCUMENTS

| | | | |
|---|---|---|---|
| 3,011,169 | 12/1961 | Cast et al. | 227/130 |
| 3,742,577 | 7/1973 | Buttriss | 227/130 |
| 3,776,444 | 12/1973 | Kuehn et al. | 227/130 |
| 4,313,552 | 2/1982 | Maurer | 227/130 |
| 4,401,251 | 8/1983 | Nikolich | 227/130 |
| 5,263,842 | 11/1993 | Fealey | 227/130 |
| 5,873,510 | 2/1999 | Hirai et al. | 227/130 |

*Primary Examiner*—Scott A. Smith
*Attorney, Agent, or Firm*—Morgan, Lewis & Bockius LLP

[57] ABSTRACT

A pneumatic nailing machine for driving a nail to a work, comprising: a main unit having a body; a cylinder disposed in the body of the main unit; a nose portion being hollow and continously extending from the main unit, the nose portion having a driver guide hole; a piston slidably inserted in the cylinder; and a driver coupled to the piston in the cylinder, and being slidable between a uppermost position and a lowermost position, wherein the driver and the piston are driven by high pressure compressed air supplied into the cylinder, and the nail supplied to the nose portion is hammered by the driver, the driver including, a base portion positioned near the piston and having a relatively large diamter so as to be substantially equal to an inner diameter of the driver guide hole, wherein the base portion is fitted into the driver guide hole when the driver reaches the lowermost position, and a tip end portion has a diameter so as to be smaller than an inner diameter of the nose portion, wherein the driver is loosely guided by the driver guide hole so as to swing during hammering, and the tip end portion of the swinging driver scrapes off tar adhering to an inner wall of the nose portion.

12 Claims, 5 Drawing Sheets

TAR REMOVING MECHANISM FOR PNEUMATIC NAILING MACHINE

BACKGROUND OF INVENTION

The invention relates to a pneumatic nailing machine in which, even when actual hammering is repeatedly conducted on asphalt roofing shingles or the like, tar adhering to a driver is prevented from sticking to the interior of a nose portion.

When an asphalt roofing shingle which is formed into a sheet-like shape is to be attached to a roof base member, usually, nails are driven via the asphalt roofing shingle into the roof base member.

In a conventional nailing machine, when actual hammering is conducted on asphalt roofing shingles, tar easily sticks to the tip end of a driver, particularly during the hot season. When the driver which has been once driven by compressed air is returned to its initial position, therefore, the tar is pulled into a nose portion. When actual hammering is repeated for a long time period, the tar is stickingly deposited on the inner wall of the nose portion, so that the sliding resistance between the driver and the nose portion is increased. As a result, there may take place a phenomenon in which the returning operation of the piston (the operation of returning the piston to the initial position) is disabled.

Conventionaly, therefore, a nailing machine must be periodically cleaned by gasoline or the like in order to remove tar.

However, the cleaning of a nailing machine must be frequently conducted during the nailing work. Furthermore, the cleaning must be conducted also after the nailing work is ended, because, when a nailing machine is left to stand overnight, tar is hardened and such hardened tar is hardly removed away. It is very cumbersome to clean a nailing machine after the nailing work is ended.

SUMMARY OF INVENTION

It is an object of the invention to provide a nailing machine which can solve the above-discussed problem and in which tar in a nose portion can be removed away during the nailing operation.

In order to attain the object of the invention, the present invention provides a pneumatic nailing machine for driving a nail to a work, comprising: a main unit having a body; a cylinder disposed in the body of the main unit; a nose portion being hollow and continously extending from the main unit, the nose portion having a driver guide hole; a piston slidably inserted in the cylinder; and a driver coupled to the piston in the cylinder, and being slidable between a uppermost position and a lowermost position, wherein the driver and the piston are driven by high pressure compressed air supplied into the cylinder, and the nail supplied to the nose portion is hammered by the driver, the driver including, a base portion positioned near the piston and having a relatively large diamter so as to be substantially equal to an inner diameter of the driver guide hole, wherein the base portion is fitted into the driver guide hole when the driver reaches the lowermost position, and a tip end portion has a diameter so as to be smaller than an inner diameter of the nose portion, wherein the driver is loosely guided by the driver guide hole so as to swing during hammering, and the tip end portion of the swinging driver scrapes off tar adhering to an inner wall of the nose portion.

DETAILED DESCRIPTION OF PREFERRED EMBODIMENTS

Figure 1:
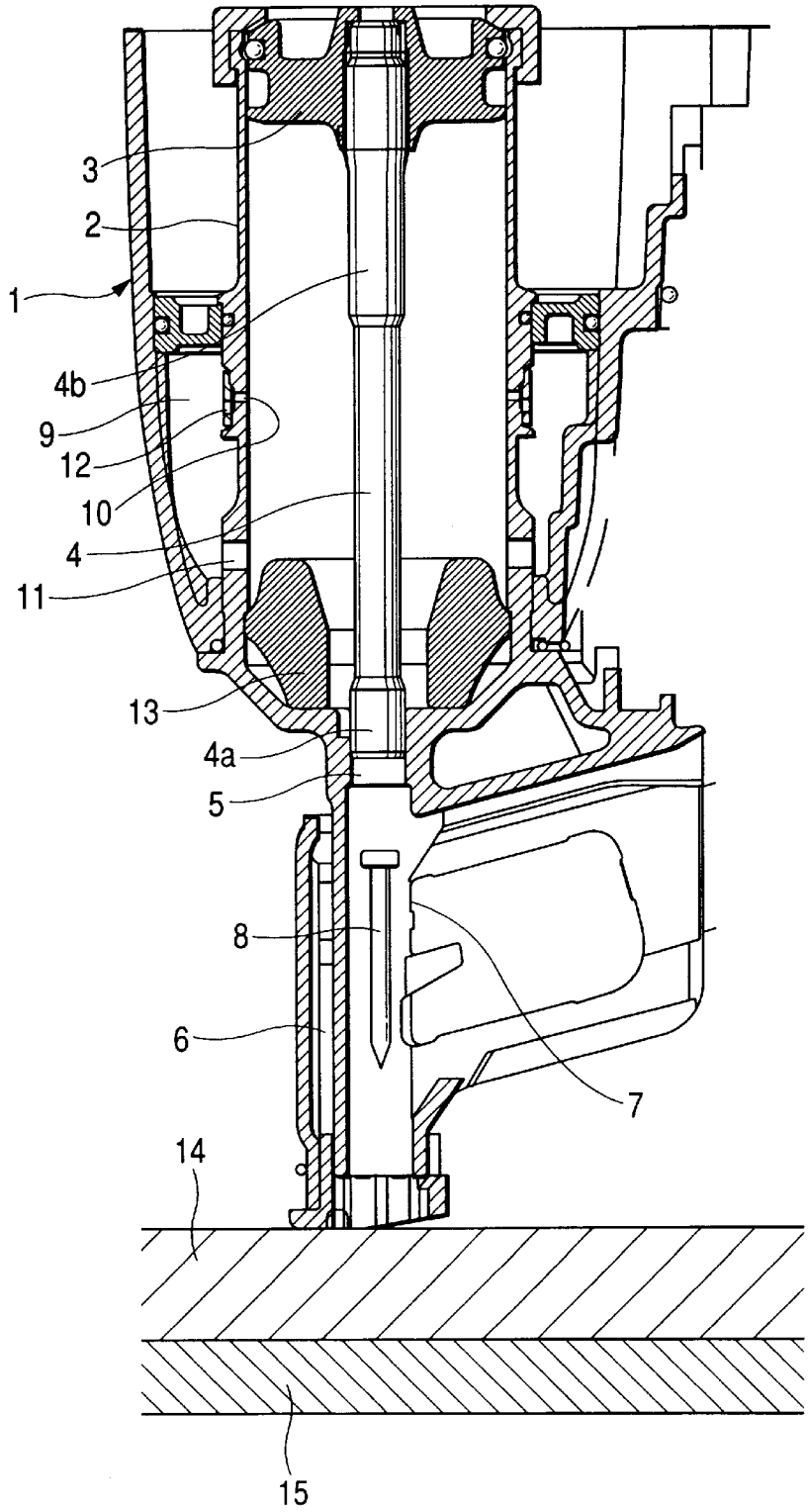
FIG. 1 is a section view of portions of a nailing machine according to an embodiment of the invention.

FIG. 1 shows a main unit 1 of a nailing machine according to an embodiment of the present invention. A cylinder 2 is disposed in the nailing machine main unit 1, a piston 3 is slidably housed in the cylinder 2, and a driver 4 is integrally coupled with the piston 3. A hollow nose portion 6 is formed below the cylinder 2 so as to be continuous therefrom via a driver guide hole 5. One side of the nose portion 6 defining a nose portion hole 20 is opened. A nail feeding mechanism which supplies a nail 8 via the opening 7 to the nose portion 6 is disposed in the nailing machine main unit 1. The driver 4 is vertically driven together with the piston 3 by supplying high pressure compressed air into the cylinder 2. The nail 8 supplied to the nose portion 6 is hammered out by the driver 4.

A blow-back air chamber 9 is formed outside the lower portion of the cylinder 2. The cylinder 2 is communicated with the blow-back air chamber 9 via upper and lower through holes 10 and 11. A check valve 12 configured by an elastic member is disposed in the upper through hole 10 and on the side of the blow-back air chamber 9. A damper 13 is disposed in the bottom portion of the cylinder 2.

Figure 2:
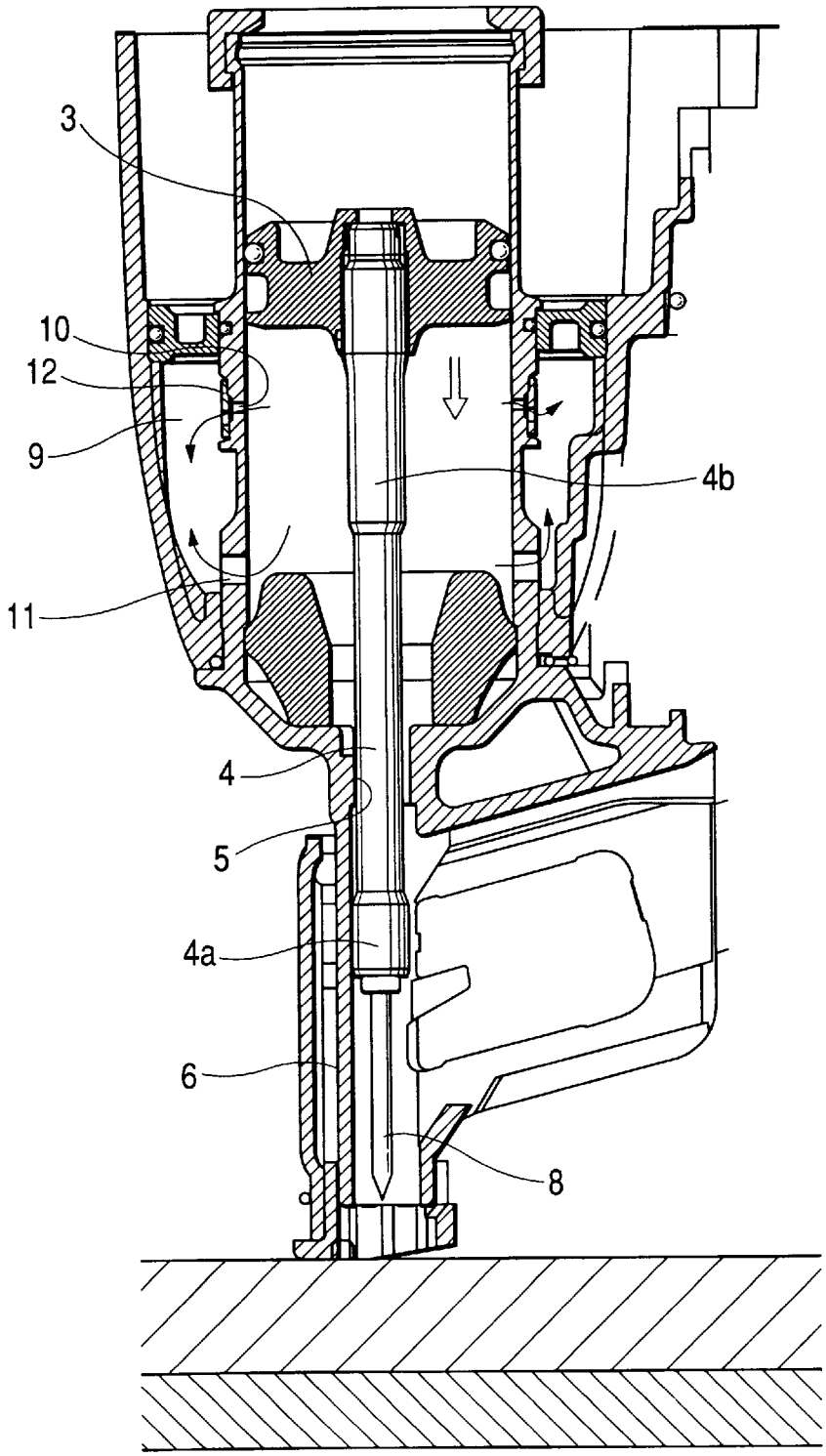
FIG. 2 is a section view showing a state during a nail driving operation.
Figure 3:
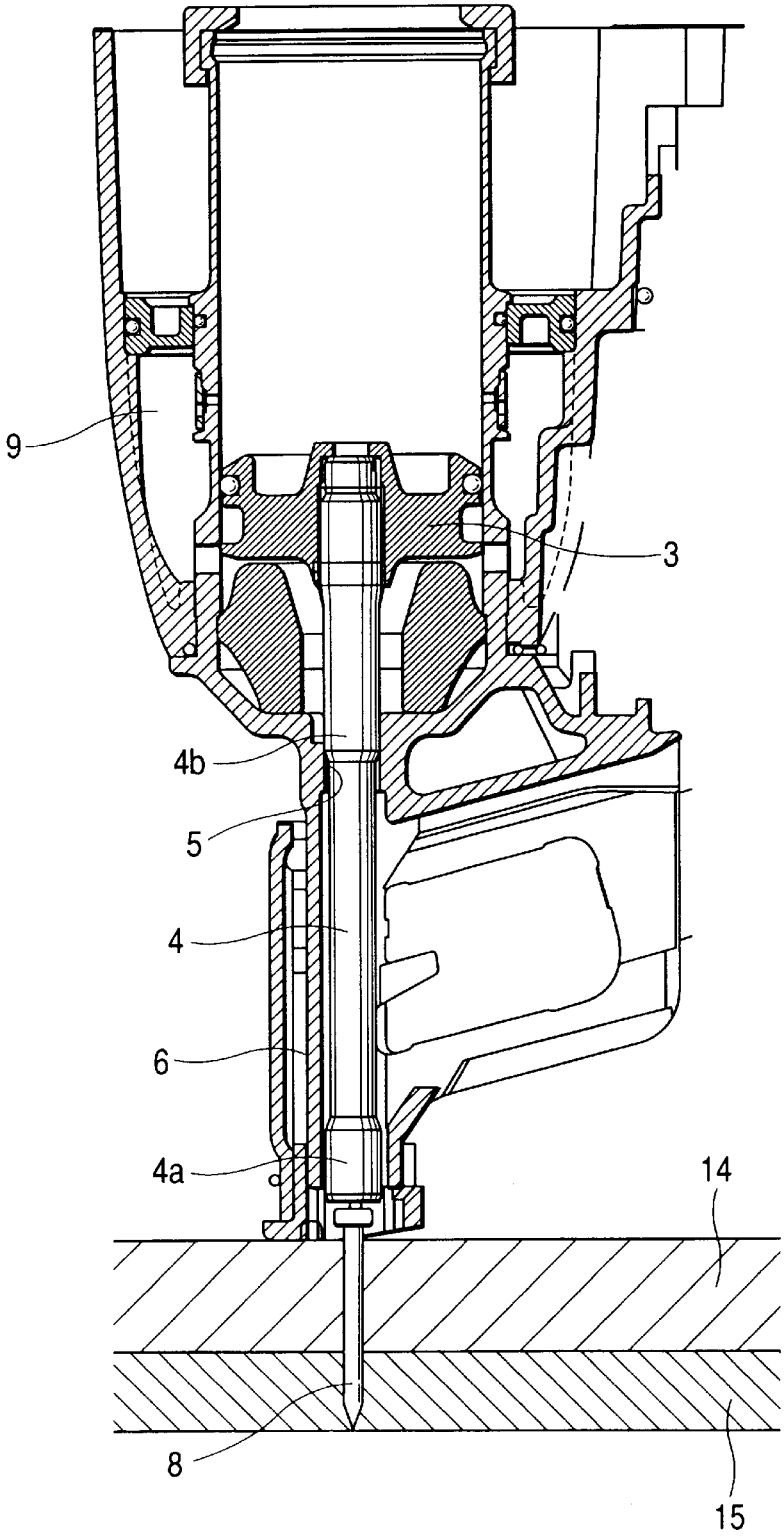
FIG. 3 is a section view showing a state in which a driver reaches the lowermost position.

The dimensions of the driver 4, the driver guide hole 5, and the nose portion 6 are set so as to have the following relationships. Large-diameter portions 4*a* and 4*b* which have a relatively large diameters are formed in the tip end and base portions of the driver 4, respectively. The outer diameters of the large-diameter portions 4*a* and 4*b* are substantially equal to the inner diameter of the driver guide hole 5, and slightly smaller than the inner diameter of the nose portion hole 20 of the nose portion 6. According to this configuration, when the driver 4 is at the uppermost position as shown in FIG. 1, the tip end portion 4*a* of the driver 4 is closely fitted into the driver guide hole 5. When the driver 4 is in the course of operation as shown in FIG. 2, gaps are formed between the driver 4, and the driver guide hole 5 and the nose portion 6. When the driver 4 reaches the lowermost position as shown in FIG. 3, the base portion 4*b* of the driver 4 is closely fitted into the driver guide hole 5. A gap is formed between the tip end portion 4*a* of the driver 4 and the nose portion 6 irrespective of the position of the driver 4.

Next, an example in which a nail is driven via an asphalt roofing shingle into a roof base member by the thus configured nailing machine will be described. First, a trigger lever which is not shown is pulled to supply compressed air into the cylinder 2. As shown in FIGS. 1 to 3, the driver 4 is then driven together with the piston 3 from the uppermost position toward the lowermost position. A nail 8 supplied into the nose portion 6 is hammered, so that an asphalt roofing shingle 14 is fixed to a roof base member 15.

During the movement of the driver 4 toward the lowermost position, the air under the piston 3 is compressed. As shown in FIG. 2, therefore, part of the air is supplied into the blow-back air chamber 9 via the lower through hole 11, and other part of the air is discharged to the outside via a gap between the driver guide hole 5 and the driver 4. As a result, the pressure rise under the piston is suppressed so that the reduction of the driving force due to the back pressure is prevented from occurring. When the driver 4 reaches the lowermost position as shown in FIG. 3, the expanded portion 4*b* of the base portion of the driver 4 is fitted into the driver guide hole 5, and hence the compressed air cannot escape to the outside via the driver guide hole 5. Therefore, the compressed air which is supplied into the blow-back air chamber 9 and increased in pressure remains in the chamber 9. Furthermore, compressed air is supplied into the blow-back air chamber 9 via the upper through hole 10 after the piston passes over the upper through hole 10, so that compressed air of an amount sufficient for returning the piston to the initial position is ensured in the blow-back air chamber 9. The check valve 12 prevents the compressed air in the blow-back air chamber 9 from reversely flowing into the cylinder 2 via the upper through hole 10.

Figure 4:
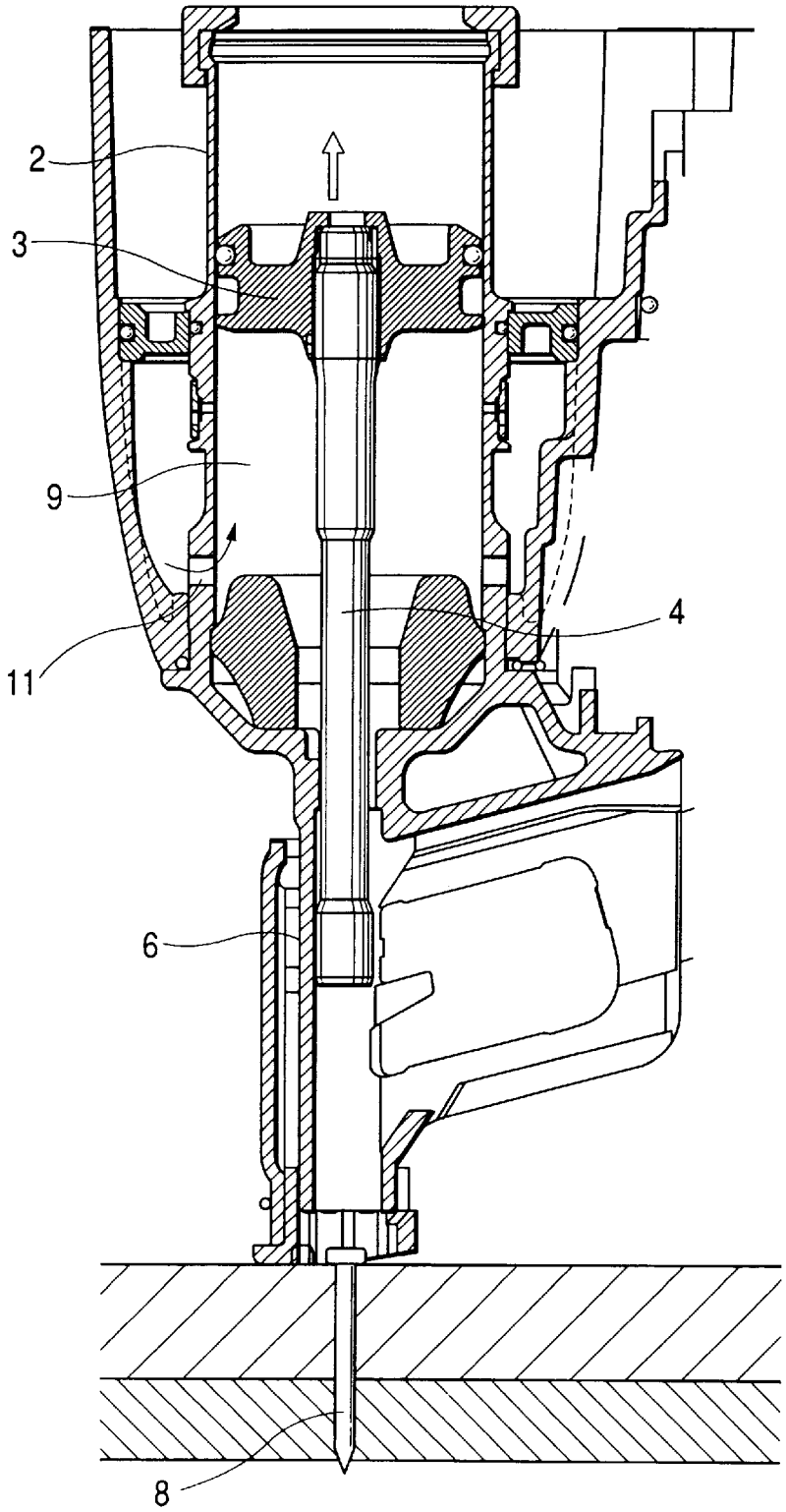
FIG. 4 is a section view showing a state in which the driver is returning.

When the trigger lever is then released, the compressed air supplied to the cylinder 2 is discharged, so that the pressure on the upper side of the piston 3 is reduced and, as shown in FIG. 4, the pressure of the compressed air supplied into the cylinder 2 acts on the lower side of the piston from the blow-back air chamber 9 via the lower through hole 11. Therefore, the piston 3 is returned toward the uppermost position and the nail driving operation is ended. When the piston 3 is upward moved, tar of the asphalt roofing shingle adheres to the tip end of the driver 4. Therefore, the upward movement of the driver 4 may cause the tar to adhere to the inner wall of the nose portion 6.

Figure 5:
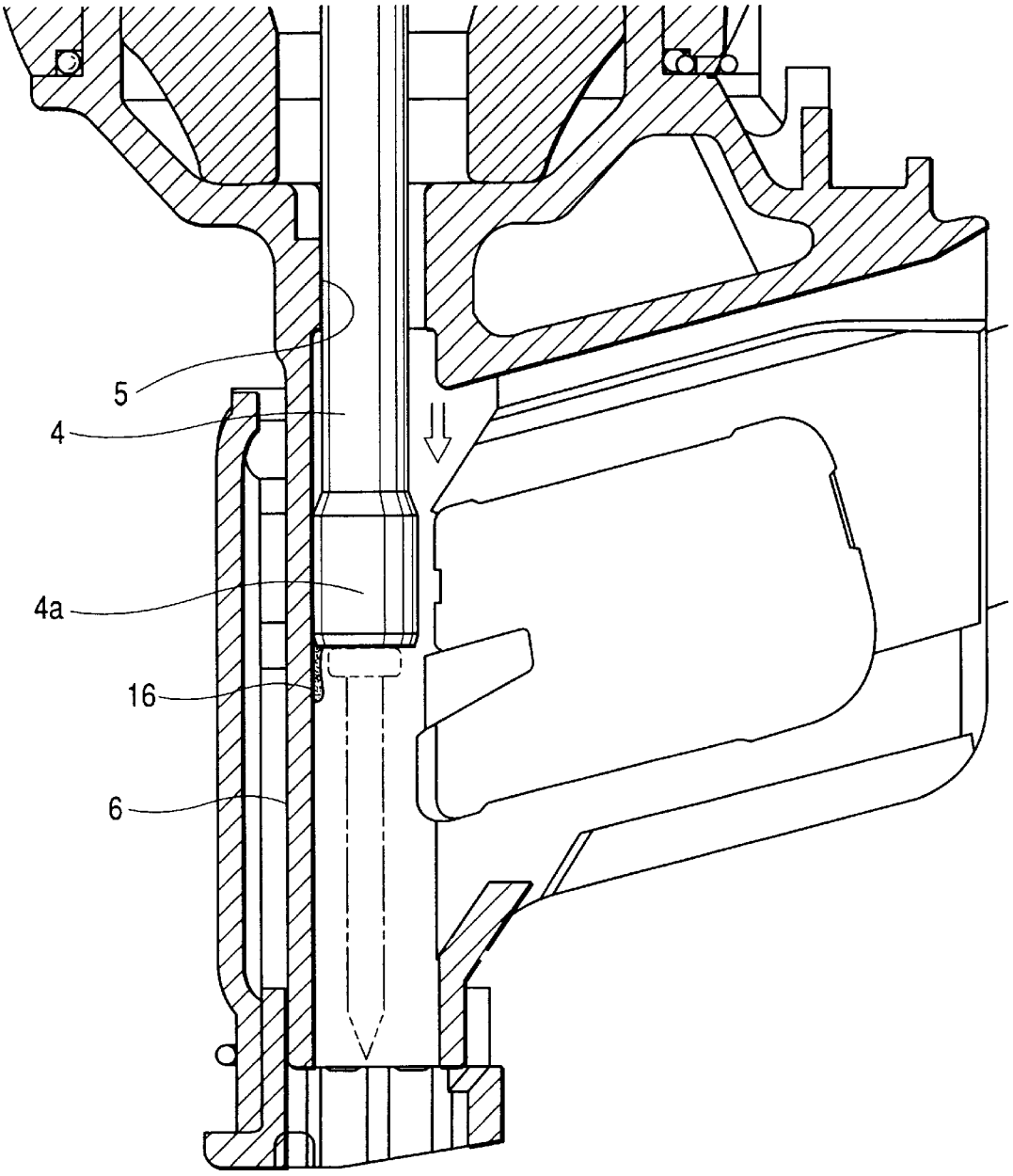
FIG. 5 is an enlarged view of a part of FIG. 2.

When, in the next nail driving operation, the driver 4 is driven together with the piston 3 from the uppermost position toward the lowermost position, the driver 4 swings during the operation in a direction perpendicular to the center axis of the driver because the outer diameter of the driver 4 is smaller than the inner diameter of the nose portion 6 and the driver is loosely guided only by the driver guide hole 5. Since the driver 4 swings, the tip end of the driver 4 bumps against the inner wall of the nose portion 6 so as to move while rubbing the inner wall as shown in FIG. 2. As a result, tar 16 adhering to the inner wall is scraped off by the driver 4 as shown in FIG. 5. The swing direction of the driver 4 is variously changed every time hammering is conducted, and repeated nailing works result in that the tip end of the driver 4 bumps against various portions of the inner wall of the nose portion 6. Consequently, tar is thoroughly scraped off and removed away during nail driving operations. Therefore, it is not required to wash the nailing machine during the nailing work and after the end of the nailing work.

In the embodiment described above, the tip end portion 4*a* of the driver is expanded. The tip end portion is not restricted to the expanded one and may be configured in any manner as far as the tip end portion 4*a* can rub the inner wall of the nose portion 6.

Since the outer diameter of the driver 4 is substantially equal to the inner diameter of the driver guide hole 5, a gap is not formed between the driver 4 and the driver guide hole 5 when the driver 4 reaches the lowermost position, and hence the air compressed under the piston 3 cannot escape to the outside via the driver guide hole 5. Therefore, most of the compressed air in the blow-back air chamber 9 which flows into the cylinder 2 via the lower through hole is used for the upward movement of the piston 3, with the result that the returning performance of the piston 3 is not impaired.

What is claimed is:

1. A pneumatic nailing machine for driving a nail into a workpiece, comprising:

a main unit having a body;

a cylinder disposed in the body of the main unit;

a hollow nose portion continuously extending from the main unit, the nose portion defining a driver guide hole having an inner diameter and a nose portion hole having an inner diameter, the driver guide hole inner diameter being smaller than the nose portion hole inner diameter;

a piston slidably inserted in the cylinder; and a driver coupled to the piston in the cylinder, and being slidable between an uppermost position and a lowermost position, wherein the driver and the piston are driven by high pressure compressed air supplied into the cylinder, and the nail supplied to the nose portion is hammered by the driver, the driver including, a base portion positioned near the piston and having a relatively large diameter so as to be substantially equal to an inner diameter of the driver guide hole, wherein the base portion is fitted into the driver guide hole when the driver reaches the lowermost portion, and a tip end portion having a diameter so as to be smaller than an inner diameter of the nose portion hole, wherein the driver is loosely guided by the driver guide hole so as to swing during hammering, and the tip end portion of the driver scrapes off tar adhering to an inner wall of the nose portion.

2. The pneumatic nailing machine according to claim 1, wherein the diameter of the tip end portion of the driver is substantially equal to the inner diameter of the driver guide hole.

3. The pneumatic nailing machine according to claim 1, wherein a diameter of the driver between the base portion and the tip end portion is smaller than the diameter of the base portion and the diameter of the tip end portion.

4. The pneumatic nailing machine according to claim 1, wherein the diameter of the base portion and the diameter of the tip end portion of the driver are substantially equal to the inner diameter of the driver guide hole.

5. The pneumatic nailing machine according to claim 1, wherein the diameter of the base portion and the diameter of the tip end portion of the driver are smaller than the inner diameter of the nose portion hole.

6. The pneumatic nailing machine according to claim 5, wherein the diameter of the base portion and the diameter of the tip end portion of the driver are substantially equal to the inner diameter of the driver guide hole.

7. The pneumatic nailing machine according to claim 6, wherein the tip end portion of the driver is closely fitted into the driver guide hole when the driver is at the uppermost position.

8. The pneumatic nailing machine according to claim 7, wherein the driver has a portion with a smaller diameter than and positioned between the base portion and the tip portion, and the smaller diameter portion of the driver passes through the driver guide hole as the driver moves from its uppermost position to its lowermost position.

9. The pneumatic nailing machine according to claim 8, wherein the driver has a longitudinal axis and the tip end portion of the driver swings with respect the driver longitudinal axis as the smaller diameter portion of the driver passes through the driver guide hole.

10. The pneumatic nailing machine according to claim 1, wherein the tip end portion of the driver is closely fitted into the driver guide hole when the driver is at the uppermost position.

11. The pneumatic nailing machine according to claim 10, wherein the driver has a portion with a smaller diameter than and positioned between the base portion and the tip portion, and the smaller diameter portion of the driver passes through the driver guide hole as the driver moves from its uppermost position to its lowermost position.

12. The pneumatic nailing machine according to claim 11, wherein the driver has a longitudinal axis and the tip end portion of the driver swings with respect the driver longitudinal axis as the smaller diameter portion of the driver passes through the driver guide hole.

* * * * *